US006310534B1

(12) United States Patent
Brunner

(10) Patent No.: US 6,310,534 B1
(45) Date of Patent: Oct. 30, 2001

(54) RADIO INTERFERENCE SUPPRESSION CHOKE

(75) Inventor: Markus Brunner, Bessenbach (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/529,399

(22) PCT Filed: Sep. 30, 1998

(86) PCT No.: PCT/DE98/02914

§ 371 Date: Apr. 12, 2000

§ 102(e) Date: Apr. 12, 2000

(87) PCT Pub. No.: WO99/19889

PCT Pub. Date: Apr. 22, 1999

(30) Foreign Application Priority Data

Oct. 14, 1997 (DE) ..... 197 45 390

(51) Int. Cl.[7] ..... H01F 38/20
(52) U.S. Cl. ..... 336/174; 336/208
(58) Field of Search ..... 336/174, 175, 336/234, 208, 225, 179

(56) References Cited

U.S. PATENT DOCUMENTS 5,532,910 * 7/1996 Suzuki et al. ..... 361/813
5,815,060 * 9/1998 Matsumoto et al. ..... 336/175

FOREIGN PATENT DOCUMENTS 0 306 041 3/1989 (EP) .
0 655 754 5/1995 (EP) .

OTHER PUBLICATIONS

Toshiba Corporation Material & Components, Technical Data, Amorphous Noise Suppressor, AMOBEAD™, Serial No. E–63001, Jan. 30, 1988.
Patent Abstract of Japan: JP 01 081209 dated Mar. 27, 1989.
Patent Abstract of Japan: JP 02 292805 dated Dec. 4, 1990.
Patent Abstract of Japan: JP 08 172019 dated Jul. 2, 1996.

* cited by examiner

*Primary Examiner*—Lincoln Donovan
*Assistant Examiner*—Tuyen Nguyen
(74) *Attorney, Agent, or Firm*—Schiff Hardin & Waite

(57) ABSTRACT

A choke for suppressing radio interference, having a terminal wire composed of an electrically conductive and thermally conductive, non-ferromagnetic, first alloy and having a magnetic tape core composed of a ferromagnetic, second alloy. The magnetic tape core includes a thin band wound into a coil around the terminal wire that has one end positively connected to the terminal wire.
In addition, an optimum thermal contact of the magnetic tape core with a printed circuit board via the terminal wire implemented as current-carrying conductor is achieved by the to choke. As a result, an excess temperature occurring in the magnetic tape core can be reduced to values compatible for the alloys employed. In this way, the problem of aging, which depends functionally on the temperature, can be dramatically minimized.

22 Claims, 2 Drawing Sheets

RADIO INTERFERENCE SUPPRESSION CHOKE

BACKGROUND OF THE INVENTION

The present invention is directed to a choke for suppressing radio interference and is also directed to a method for the manufacture thereof.

In clocked power pack parts, particularly in switched power pack parts, electromagnetic interference occurs due to extremely steep voltage or, current edges during the switching operations of the power pack part. This so-called "broad band radio interference", however, is undesired. The frequency of the radio interference the region of a few hundred kilohertz up into the megahertz range. In conformity with the standards of electromagnetic compatibility (EMC), this radio interference is to be eliminated at the point of creation, (i.e., within the device).

What is probably the most effective method for suppressing radio interference is the employment of what are referred to as single-conductor chokes. Single-conductor chokes are chokes for suppressing radio interference that are fashioned as annular magnetic tape cores that can be plugged onto a wire or onto a terminal pin of a circuit component. Such chokes for suppressing radio interference are known, for example, from the Data Book of the Toshiba Corporation, Material & Components, Technical Data, "Amorphous Noise Suppressor, AMOBEAD™, Serial No. E-63001, Jan. 30, 1988.

Compared to other components for suppressing radio interference, such as a RC low-pass, for example, single-conductor chokes have the advantage of high inductances even given high choke currents as well as a broad band interference suppression effect in the range from 10 kHz through 30 MHZ. Further, they also exhibit an especially high insertion attenuation in the lower frequency range. Finally, they exhibit low overall losses and low structural sizes.

What are referred to as single-conductor chokes in the form of small, wound magnetic tape cores of amorphous alloys, particularly on a cobalt basis, are discussed in the aforementioned document. The wound magnetic tape cores are slipped or, plugged onto the conductors carrying the current in the component part causing the interference. There, the chokes act as saturatable chokes with whose assistance high-frequency disturbances can be effectively combated during a switching event. Due to the saturation of the magnetic material of the magnetic tape core, however, influencing of the circuit to be protected no longer occurs following the switching event.

In the manufacture of such a magnetic tape core composed of an amorphous alloy, however, the tape to be wound is usually secured to a winding shaft made of tool steel with a spot weld. After the welding, the magnetic tape core is wound to desired geometrical configuration. Finally, the tape end is, in turn, secured to the outside circumference of the magnetic tape core with a spot weld. After the end of the welding process, the magnetic tape core is shorn from the winding shaft. The annular magnetic tape core that has been formed as a result can then be further-processed in a known way. In particular, the magnetic tape core is subjected to a thermal treatment and is subsequently covered with a passivation layer.

Such single-conductor chokes, however, are complicated to manufacture since the annular component parts must be manually attached over the terminal pins, for example of a transistor or a diode. The adjustment of the annular single-conductor choke around the terminal pins thereby plays a particularly large part and requires additional assembly outlay.

Another critical disadvantage derives from the extremely poor thermal contact of the magnetic tape core relative to the terminal pins of the circuit and an inadequate elimination of the unwanted heat from the magnetic tape core that is caused as a result thereof The dissipated heat arising, for example, given a magnetization into saturation at frequencies in the range of a few hundred kilohertz thus usually leads to a heating of the components of more than 100° C. As a result of these high temperatures and due to the magnetic field in winding direction generated by the operating current, a tempering occurs that, unbeneficially causes a rectangular hysteresis loop that in turn, intensifies the magnetic field in winding direction. Over time, however, the alloys that are utilized cannot overcome these high temperatures, this leading to an aging of the material of the magnetic tape core with corresponding changes in the magnetic properties of the alloys. These usually cause a further increase in the re-magnetization losses, which can ultimately lead to the thermal failure of the choke.

European reference EP A 0655754 discloses an inductive component, whereby a magnetic foil is tightly wound around a terminal wire to form a magnetic tape core.

SUMMARY OF THE INVENTION

It is therefore an object of the present invention to specify a choke for suppressing radio interference that can be manufactured with extremely little assembly outlay and that exhibits extremely good thermal contact of the magnetic tape core with the circuit for the elimination of the dissipated heat from the magnetic tape core.

This and other objects are inventively achieved by a choke for suppressing radio interference featuring

- a terminal wire composed of an electrically conductive and thermally conductive, non-ferromagnetic, first alloy; and
- a thin band composed of a ferromagnetic, second alloy that is wound around the terminal wire to form a coil and that has its inner end positively connected to the terminal wire.

As a result of the inventive choke for suppressing radio interference, said assembly difficulties are avoided and the problem of the thermal coupling of the choke to the rest of the circuit is also solved. All other said advantages, particularly the very good attenuation properties, are preserved unmitigated.

A terminal wire that serves as winding shaft for the magnetic tape core is employed for manufacturing magnetic tape cores given the inventive choke for suppressing radio interference. The material of the terminal wire is composed of an alloy that is capable of being spot welded for welding the magnetic band to be wound and that can also be soft-soldered for later assembly of the component. The terminal wire employed as winding shaft of the magnetic tape core remains in the magnetic tape core following the winding of the core and then serves as electrical conductor of the component.

After the winding, magnetic tape cores are potentially subjected to a thermal treatment for setting the magnetic properties. An enveloping of the magnetic tape core, for example on the basis of a standard lacquer or a shrink hose, is subsequently available. An epoxy powder lacquer can then be employed as lacquer. However, it would also be conceivable to envelope the magnetic tape core with a thermoplastic or duroplastic press compound.

The component part that is then formed is externally comparable to a conventional resistor and can, of course, be further processed like such a resistor with appropriate automatic equipping units such as those standard in printed circuit board manufacture. In particular, it is thereby advantageous when the inventive chokes for suppressing radio interference are implemented as Surface Mounted Device (SMD) components.

Additional advantages and novel features of the invention will be set forth, in part, in the description that follows and, in part, will become apparent to those skilled in the art upon examination of the following or may be learned by practice of the invention. The advantages of the invention may be realized and attained by means of the instrumentalities and combination particularly pointed out in the appended claims.

BRIEF DESCRIPTION OF THE DRAWINGS

The invention is explained in greater detail below with reference to the exemplary embodiments indicated in the figures of the drawings. Wherein shown are.

DETAILED DESCRIPTION OF THE PREFERRED EMBODIMENTS

Figure 1:
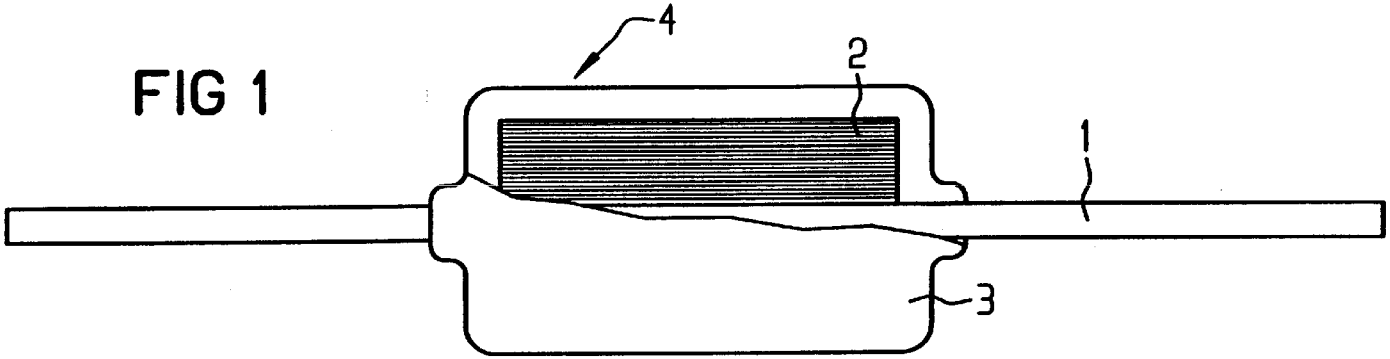
FIG. 1 illustrates an inventive single-conductor choke that is implemented as a pinned component.

In FIG. 1, 1 references a terminal wire. The terminal wire 1 can comprise a circular, rectangular or similar cross section. It would also be conceivable that the terminal wire 1 is fashioned ribbon-like. A magnetic tape core 2 is arranged around the terminal wire 1. The magnetic tape core 2 is typically composed of a thin band over a thin foil that is wound coil-like around the terminal wire 1. In addition, a protective coating 3 can be provided in the region of the magnetic tape core 2 for advantageously protecting the magnetic tape core 2.

The terminal wire 1, the magnetic tape core 2 and the protective coating 3 then form a single-conductor choke 4. The ends of the terminal wire 1 can thereby serve as a plug-type connection. Typically, the ends of the terminal wire 1, however, are soldered into the circuit of an integrated circuit.

Figure 2:
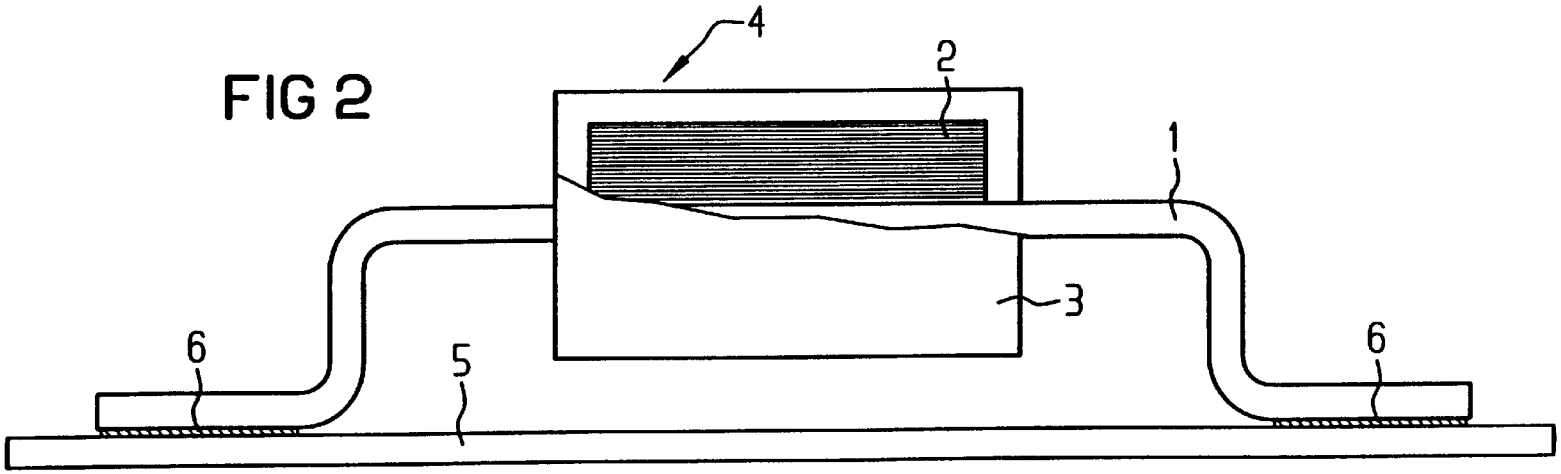
FIG. 2 illustrates an inventive single-conductor choke that is implemented as a SMD component.

FIG. 2 shows a further single-conductor choke 4 that is implemented here as what is referred to as a SMD component (surface mounted device component). Identical elements in FIG. 2 are provided with the same reference characters as in FIG. 1.

The single-conductor choke 4 in FIG. 2 differs from that in FIG. 1 essentially on the basis of the housing structure. The SMD component shown here is suitable for surface mounting on a motherboard. Here, the terminal wire 1 is angled as a L-shape in the region not covered by the magnetic tape core 2. It would also be conceivable as shown, for example, in FIG. 2 that the regions of the terminal wire 1 not covered by the magnetic tape core 2 are fashioned with multiple L-shaped angles.

In addition, reference number 5 in FIG. 1 references a printed circuit board. The single-conductor choke 4 is connected to the printed circuit board 5 via a soldered connection 6 at the ends of the terminal wire angled, L-shaped.

The following manufacturing steps are required for manufacturing the single-conductor chokes 4 shown in FIGS. 1 and 2.

First, a wire is cut to a predetermined length, this then forming the terminal wire 1. For manufacturing the magnetic tape core 2, an amorphous, thin band or a thin magnetic foil then has its one end soldered to the terminal wire 1.

Subsequently, this thin band is wound coil-like around the terminal wire 1 to form a magnetic tape core 2. The second end of the band is subsequently likewise secured to the outside circumference of the wound-up coil by spot welding. In this way, one typically obtains an annular magnetic tape core 2. It is especially advantageous when the annular magnetic tape core 2 is fashioned as a closed ring.

This is then typically followed by a heat-treatment step. The thermal treatment thereby typically ensues in a pass. The pass speed is selected such that the thin band is heated to a temperature "T" between 450° C. and 550° C. for a thermal treatment time t from 0.5 sec to 120 sec. This thermal treatment step serves, among other things, for the purpose of mechanical relaxation treatment of the magnetic tape core 2. The permeability and, thus, the insertion attenuation correlated therewith can thus be optimized in the desired way. Finally, the magnetic tape core 2 is treated in a magnetic field in order to set the desired hysteresis.

After the wound magnetic tape core 2 has been further-treated in the way described above, it is especially advantageous to apply a protective coating 3 in the region of the magnetic tape core 2. The protective coating 3 particularly serves the purpose of mechanically protecting the magnetic tape core 2.

An epoxy powder lacquer or, respectively, a thermoplastic or duroplastic press compound can serve as protective coating 3. However, it would also be conceivable to cover the single-conductor choke 4 with a simple shrink hose.

It is critical to the invention that the material of the terminal wire 1 can be welded as well as soldered. Further, it is critical that the material employed for the terminal wire 1 exhibits an adequately high electrical conductivity as well as high thermal conductivity. Moreover, it is compulsory that the material of the terminal wire 1 is itself not ferromagnetic. These demands made of the material of the terminal wire 1 are ideally met by alloys having a copper basis. Resistance-increasing elements such as, for example, nickel, beryllium, chromium, zirconium, manganese or similar elements are alloyed in here for achieving the capability of spot-welding. Commercially available resistor alloys such as copper-nickel alloys or, copper-manganese alloys are most common.

An adequately good capacity for spot-welding of the terminal wire 1 to the ferromagnetic materials of the magnetic tape core 2 is achieved with an alloy for the terminal wire that is composed of the formula $Cu_{100-(a+b)}Ni_aMn_b$. The variables a and b indicate the in weight percent and satisfy the following conditions: $6 \leqq a \leqq 80$ and $0 \leqq b \leqq 12$.

The best results are achieved with a relatively low, alloyed nickel content of approximately 6% weight and manganese content of approximately 3% weight. The nickel part of these alloys is upwardly limited, on the one hand, by the electrical conductivity that decreases with increasing nickel content and, on the other hand, by the creation of ferromagnetic compositions. The preferred composition lies in the range from approximately 6–50% weight nickel with additives of 0–6% weight manganese. The commercial alloy $CuMn_3$ from the copper-manganese system can, for example, be employed.

Another alloy for the terminal wire 1 having good capacity for spot-welding is achieved with an alloy that is composed of the formula $Cu_{100-(a+b)}Mn_aGe_b$. The variables a and b are thereby likewise indicated in weight percent and satisfy the following conditions: $3 \leqq a \leqq 6$ and $0 \leqq b \leqq 6$.

An extremely simple possibility for the lead wire 1, however, is also comprised in the employment of simple copper wires that are provided with a surface coating that can be spot-welded and soldered. A coating having these properties can be produced, for example, by nickel-plating. A layer thickness of the nickel plating in the range from approximately 2 through 30 $\mu$m is thereby adequate in order to assure the required good capacity for spot-welding and soldering. With respect to the terminal wire 1 employed as electrical conductor, this version offers both the most beneficial electrical properties as well as the most beneficial thermal conductivity.

The additional eddy current losses arising in the ferromagnetic nickel layer in fact lead to a slight, additional heating of the component. However, this effect remains within a justifiable scope due to the extremely low layer thickness of the nickel coat. It is also advantageous, in turn, to partially remove the nickel coating in an etching solution in the regions that are not covered by the magnetic tape core 2 after the enveloping of the magnetic tape core 2.

It is absolutely compulsory for the function of the choke for suppressing radio interference that the material of the magnetic tape core 2 be composed of an amorphous or nano-crystalline, highly permeable, ferromagnetic alloy. It is especially advantageous when this alloy is composed of soft-magnetic material.

It is especially advantageous when an amorphous alloy having a cobalt basis or a nano-crystalline alloy having an iron basis is the material utilized. Typically, these alloys exhibit a saturation magnetostriction of $|\lambda_s| \leqq 5$ ppm.

The envelope offers the simplest form of implementing the protective coated 3 of the single-conductor chokes 4. The component is thereby coating with a powder lacquer in the region of the magnetic tape core 2. Structures that are externally comparable to conventional resistors are thereby obtained, these being applied in pinned form on the printed circuit board 5 and being soldered.

A further structure of great interest for later mounting can be realized by extrusion-coating the region of the magnetic tape core 2 with a thermoplastic or duroplastic molding compound in cuboid form and subsequent cutting and coining of the conductor. In this way, SMD components are obtained, these leading to a clear reduction of the technical outlay in the component mounting and being capable of being manufactured in a cost-beneficial way.

The thermal bond to the surrounding circuit is comparably good in both structures, so that no series differences are to be anticipated here with respect to the employment properties.

In conformity with the illustrated exemplary embodiments, copper-nickel terminal wires having different composition were manufactured upon employment of an amorphous cobalt alloy. Given magnetic tape cores 2 without thermal treatment, alternating field permeabilities of approximately 3000 are achieved at 1 kHz. At higher test frequencies in the range of 1 MHZ, the alternating field permeability drops to values around approximately 1700. When, however, the magnetic tape cores 2 are subjected to a thermal treatment, then the magnetic properties are clearly improved. The alternating field permeabilities increase to values of approximately 250000 (1 kHz) or, respectively, 7000 (1 MHZ).

Figure 3:
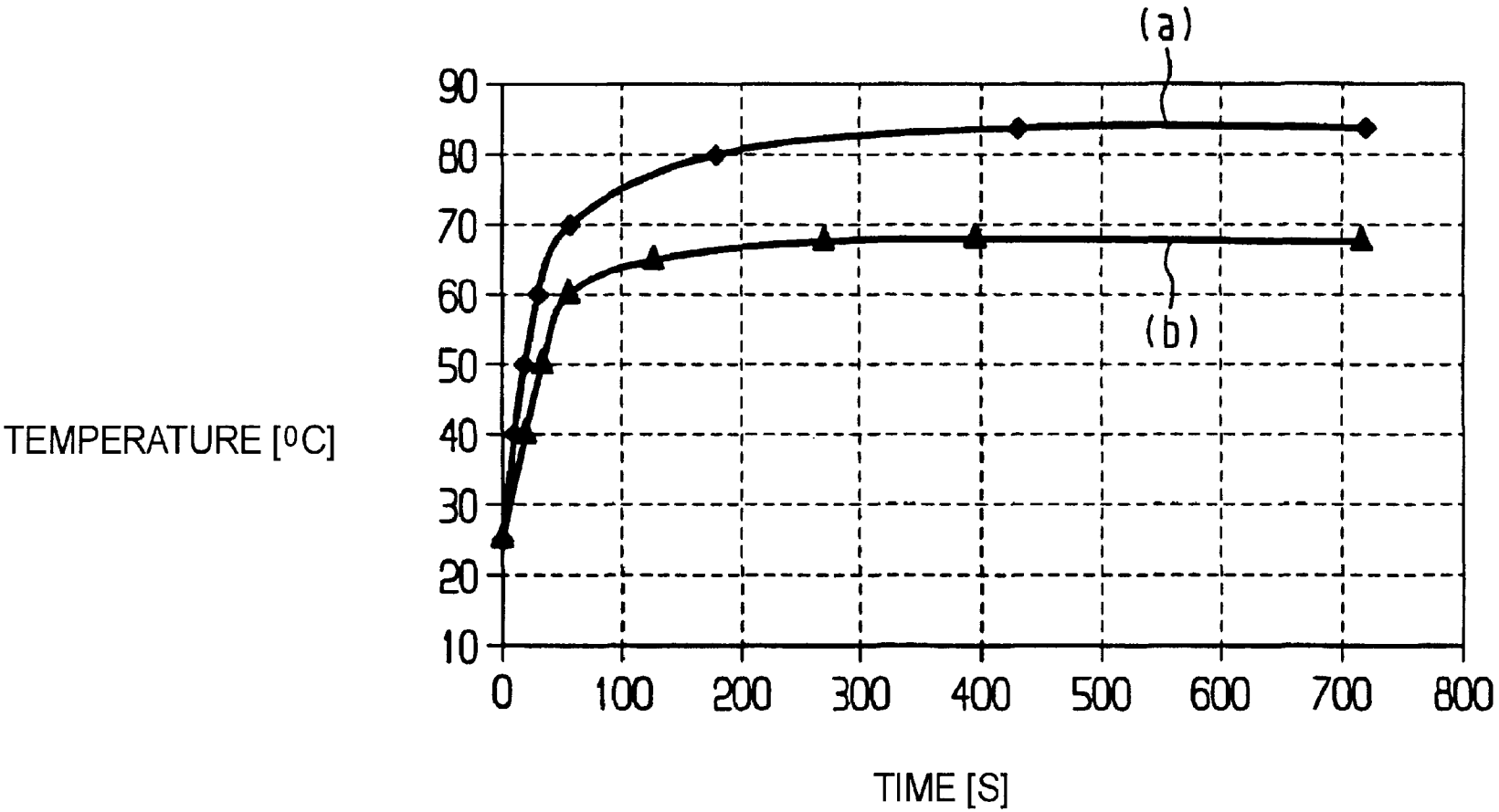
FIG. 3 illustrates a temperature/time diagram that shows the component heating of an inventive single-conductor choke (b) compared to a single-conductor choke of the prior art (a).

FIG. 3 shows a temperature-time diagram that shows the component heating of an inventive single-conductor choke b) compared to a single-conductor choke of the prior art a). In order to assure the comparability here, the same inductances were employed for the investigation of the magnetic tape cores 2. The magnetization thereby ensues at a current of $I_{eff}$=4.5 A at a frequency of 100 kHz. Under these conditions, the single-conductor choke of the prior art reached an ultimate temperature of 84° C., whereas the inventive single-conductor choke heated to a maximum of 68° C.

In addition to the automated processability as a result of the proposed structure, an optimum thermal contact of the magnetic tape core 2 relative to the printed circuit board 5 is also achieved via the terminal wire 1 implemented as current-carrying conductor. As a result thereof, an excess temperature occurring in the magnetic tape core 2 can be reduced to values compatible for the alloys employed. In this way, the problem of aging, which is functionally dependent on the temperature, can be dramatically minimized.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A choke for suppressing radio interference comprising:

a terminal wire comprised of a first alloy that is electrically and thermally conductive and non-ferromagnetic; and a magnetic tape core comprised of a second alloy that is ferromagnetic, the magnetic tape core comprising a thin band wound into a coil around the terminal wire and having an end connected to the wire terminal;

wherein the first alloy comprises $Cu_{91}Ni_6Mn_3$, expressed in weight percent.

2. The choke according to claim 1, wherein the first alloy is composed of a material having the capacity for soft-soldering and welding.

3. The choke according to claim 2, wherein the nickel coating comprises a layer thickness of 2 $\mu$m through 30 $\mu$m.

4. The choke according to claim 1, wherein the second alloy is composed of a soft-magnetic material.

5. The choke according to claim 1, wherein the second alloy is composed of a material that is at least one of highly permeable, amorphous and nano-crystalline.

6. The choke according to claim 1, wherein the second alloy is an amorphous alloy having a cobalt basis that comprises a saturation magnetostriction $|\lambda_s| \leqq 5$ ppm following a thermal treatment.

7. The choke according to claim 1, wherein the second alloy is an nano-crystalline alloy having an iron basis that comprises a saturation magnetostriction $|\lambda_s| \leqq 5$ ppm following a thermal treatment.

8. The choke according to claim 1, wherein the choke further comprises a protective coating for protecting the magnetic tape core.

9. The choke according to claim 1, wherein the terminal wire has two ends that are each shaped in an L-shape.

10. The choke according to claim 1, wherein the choke is a Surface Mounted Device component.

11. The choke according to claim 1, wherein the magnetic tape core is configured as a closed toroidal core.

12. The choke according to claim 1, wherein choke is utilized in a switched power pack part.

13. A choke for suppressing radio interference comprising:

a terminal wire comprised of a first alloy that is electrically and thermally conductive and non-ferromagnetic; and a magnetic tape core comprised of a second alloy that is ferromagnetic, the magnetic tape core comprising a thin band would into a coil around the terminal wire and having an end connected to the wire terminal;

wherein the first alloy comprises a composition having the formula $$Cu_{100-(a+b)}Mn_aGe_b,$$

where a and b are representative of weight percent and satisfy the following conditions: $3 \leqq a \leqq 6$ and $0 \leqq b \leqq 6$.

14. The choke according to claim 13, wherein the second alloy is composed of a soft-magnetic material.

15. The choke according to claim 13, wherein the second alloy is composed of a material that is at least one of highly permeable, amorphous and nano-crystalline.

16. The choke according to claim 13, wherein the second alloy is an amorphous alloy having a cobalt basis that comprises a saturation magnetostriction $|\lambda_s| \leqq 5$ ppm following a thermal treatment.

17. The choke according to claim 13, wherein the second alloy is an nano-crystalline alloy having an iron basis that comprises a saturation magnetostriction $|\lambda_s| \leqq 5$ ppm following a thermal treatment.

18. The choke according to claim 13, wherein the choke further comprises a protective coating for protecting the magnetic tape core.

19. The choke according to claim 13, wherein the terminal wire has two ends that are each shaped in an L-shape.

20. The choke according to claim 13, wherein the choke is a Surface Mounted Device component.

21. The choke according to claim 13, wherein the magnetic tape core is configured as a closed toroidal core.

22. The choke according to claim 13, wherein choke is utilized in a switched power pack part.

* * * * *